US006802396B2

(12) United States Patent
Naitoh

(10) Patent No.: US 6,802,396 B2
(45) Date of Patent: Oct. 12, 2004

(54) DOUBLE DECK ELEVATOR WITH ADJUSTABLE FLOOR HEIGHT

(75) Inventor: Yoshiaki Naitoh, Sakura (JP)

(73) Assignee: Otis Elevator Company, Farmington, CT (US)

( * ) Notice: Subject to any disclaimer, the term of this patent is extended or adjusted under 35 U.S.C. 154(b) by 209 days.

(21) Appl. No.: 10/189,712

(22) Filed: Jul. 3, 2002

(65) Prior Publication Data

US 2003/0024772 A1 Feb. 6, 2003

(30) Foreign Application Priority Data

Jul. 3, 2001 (JP) ..... 2001-201611

(51) Int. Cl.[7] ..... B66B 11/02
(52) U.S. Cl. ..... 187/401; 187/902
(58) Field of Search ..... 187/249, 401, 187/269, 267, 902

(56) References Cited

U.S. PATENT DOCUMENTS 5,220,981 A 6/1993 Kähkipuro ..... 187/16
5,907,136 A 5/1999 Hongo et al. ..... 187/277
6,334,511 B1 * 1/2002 Araki ..... 187/902

FOREIGN PATENT DOCUMENTS

| | | | | |
|---|---|---|---|---|
| JP | 04-303378 | | 10/1992 | |
| JP | 10-236753 | | 9/1998 | |
| JP | 10-279232 | | 10/1998 | |
| JP | 2000211857 | A * | 8/2000 | ..... B66B/11/02 |
| JP | 2001048447 | A * | 2/2001 | ..... B66B/11/02 |
| WO | WO 01/00519 | A1 * | 1/2001 | ..... B66B/1/14 |

* cited by examiner

*Primary Examiner*—Eileen D. Lillis
*Assistant Examiner*—Thuy V. Tran

(57) ABSTRACT

A double deck elevator includes a floor height adjusting mechanism that adjusts the distance between the upper and lower decks located within a cage frame. The adjusting mechanism includes a pantograph having an upper portion coupled to the upper deck and lower portion coupled to the lower deck. A central portion of the pantograph is fixed to a portion of the cage frame. A screw is coupled to the upper or lower portion to cause the pantograph to expand and contract to adjust the distance between the upper and lower decks. The screw is driven by a motor located between the upper and lower decks.

10 Claims, 4 Drawing Sheets

DOUBLE DECK ELEVATOR WITH ADJUSTABLE FLOOR HEIGHT

FIELD OF THE INVENTION

This invention pertains to a double deck elevator with adjustable floor height. In particular, this invention pertains to a double deck elevator with a floor height adjusting mechanism for adjusting the vertical height of the upper car and a lower car simultaneously.

BACKGROUND OF THE INVENTION

A double deck elevator has two decks arranged vertically within a single cage frame for movement within a hoistway in a building. The arrangement of two decks within a single cage increases capacity while reducing the area occupied in the building. The cage frame is driven vertically within a hoistway by means of a winding machine via a rope. At least one of the upper deck and lower deck can move within the cage frame via a floor height adjusting mechanism.

The distance between adjacent floors may not be constant throughout a building therefore, it is necessary to adjust the distance between the upper deck and lower deck to account for these varying distances.

There are several systems for adjusting floor height. In the system described in Japanese Kokai Patent Application No. Hei 4[1992], Publication No. 303378, a pantograph-shaped link mechanism is set between the lower deck and the cage frame; the link mechanism is expanded/shrunk by means of a hydraulic device using a piston cylinder, so that the lower cage chamber alone can make vertical movement. On the other hand, in the system described in Japanese Kokai Patent Application No. Hei 10[1998], Publication No. 279231 (U.S. Pat. No. 5,907,136), a pantograph-shape link mechanism is pivoted on a frame that bisects the cage frame between the upper deck and lower deck. A screw shaft set between the cage frame and one of the decks, drives the link mechanism to expand/contract so that both decks can move vertically.

A hydraulic jack is used in a system wherein the lower deck alone moves. This hydraulic jack employs a piston rod moving in/out of the hydraulic cylinder under control of a hydraulic fluid. On the other hand, in the system wherein both decks move vertically, a jack or hydraulic jack is adopted. This jack or hydraulic jack has a worm gear engaged to a worm shaft under driving of a motor and a screw shaft engaged to the threaded portion in the central hole of the worm wheel. Two sets of the jack or hydraulic jack are adopted in the left/right portions of the upper portion of the cage frame, and they are connected to the upper deck. At the same time, a pantograph is set between the upper deck and lower deck to enable adjustment of the distance therebetween.

The conventional double deck elevator requires that the two sets of jacks fixed on the left/right sides of the cage fame be synchronized to prevent the cage chamber tilting left or right.

Consequently, it is necessary to have special control equipment, servo motor and other synchronous motor or controller to ensure correct synchronization. As a result, the cost of the equipment rises.

Also, as two sets of driving devices are set in the upper portion of the cage frame, when the elevator is installed or during service and repair, the space available for operation is narrow, and there are many objects that hamper the operation. As a result, the operation efficiency decreases.

According to this invention, these problems are solved by means of a simple structure in which adjustment of the spacing between the upper cage chamber and lower cage chamber in the double deck elevator can be made in a simple structure free of synchronization control and other complicated operation. As a result, the cost of the equipment is decreased.

SUMMARY OF INVENTION

In order to overcome the problems of the prior art, a variable double deck elevator with adjustable floor height is provided. The double deck elevator has a cage frame that is positioned on a main guide rail in a hoistway, an upper deck and a lower deck vertically positioned on a sub-guide rail set in the cage frame, and a floor height adjusting mechanism set between said upper deck and lower deck or between one of said decks and the cage frame.

The floor height adjusting mechanism includes a pantograph driven by a screw shaft that can be rotated forward/backward with an electric motor supported on the inner side of said cage frame.

The use of the single screw and motor located within the cage simplifies the control of the movement of the upper and lower decks and reduces the amount of hardware located on the top of the car.

BEST MODE FOR CARRYING OUT THE INVENTION

Figure 1:
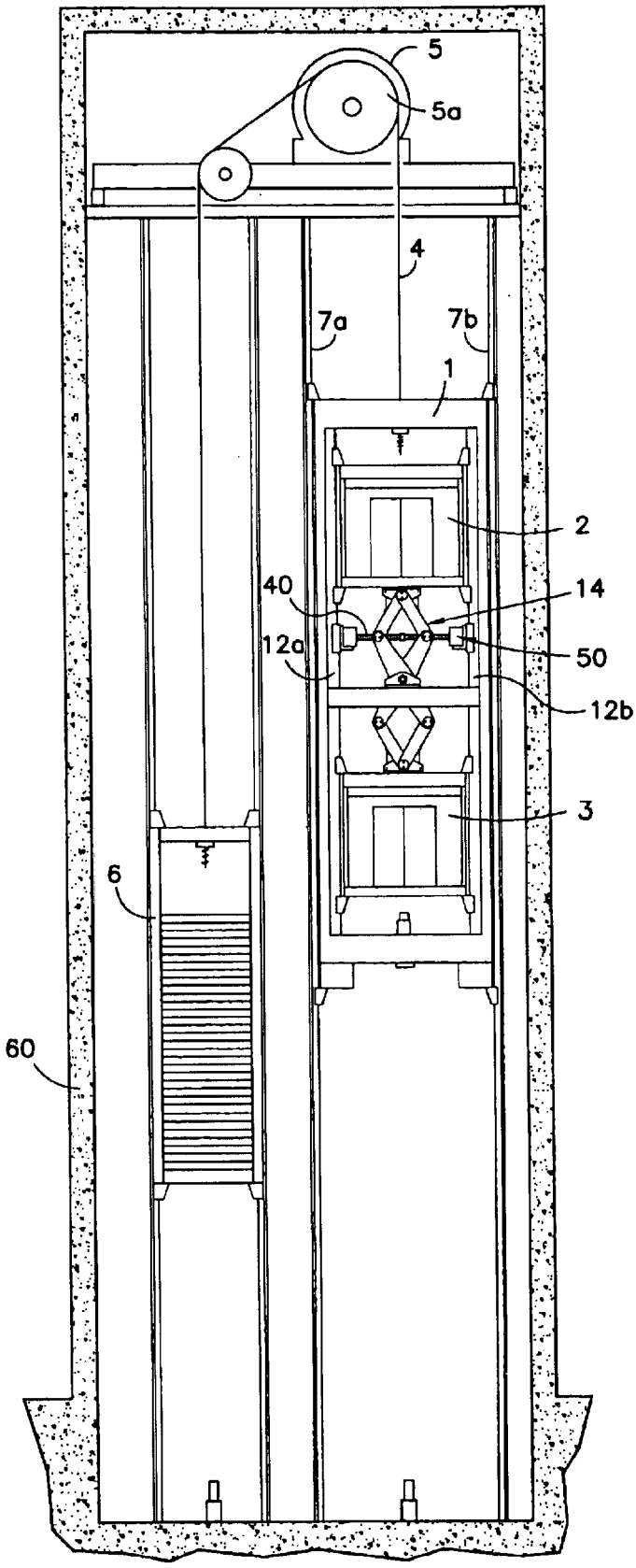
FIG. 1 is a front view of the variable double deck elevator according to the present invention.

As shown in FIG. 1, the cage frame (1) has two decks, upper deck (2) and lower deck (3), vertically arranged therein. An end of rope (4) is fastened on cage frame (1), and, after said rope (4) is engaged on driving sheave **(5*a*) of winding machine (5), the other end is fastened to counter weight (6). On the two sides of said cage frame (1), main guide rails (7*a*), (7*b*) are erected inside hoistway 60** to enable the cage to move up/down.

Figure 2:
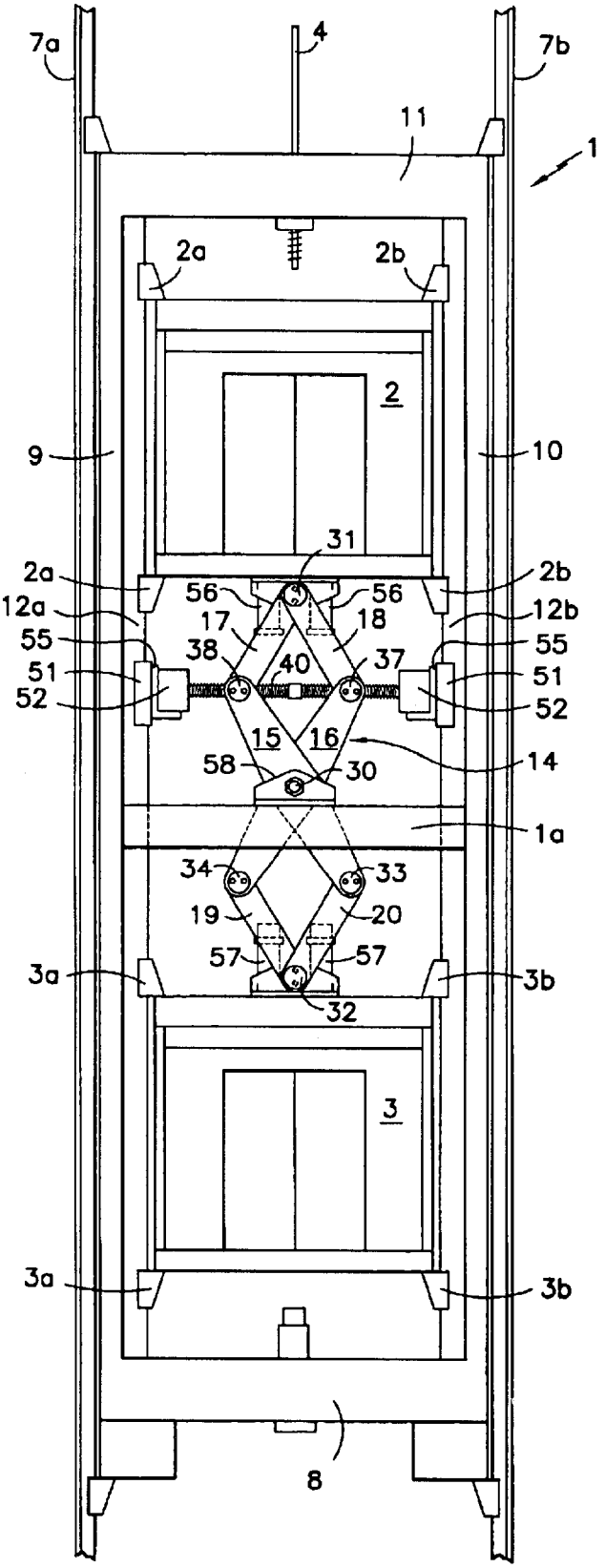
FIG. 2 is a front view of the upper and lower decks and floor height adjusting mechanism.

As shown in FIG. 2, cage frame (1) is composed of plank channel (8) on the lower side of said decks (2), (3), upright channels (9), (10) on the left/right sides, respectively, and cross head channel (11) on the upper side. In upright channels (9), (10), sub-guide rails **(12*a*), (12*b*) are set such that decks (2), (3) can move vertically with respect to cage frame (1). On sub-guide rails (12*a*), (12*b*), guide shoes (2*a*), (2*b*) and (3*a*), (3*b*) installed on upper deck (2) and lower deck (3)**.

Figure 3:
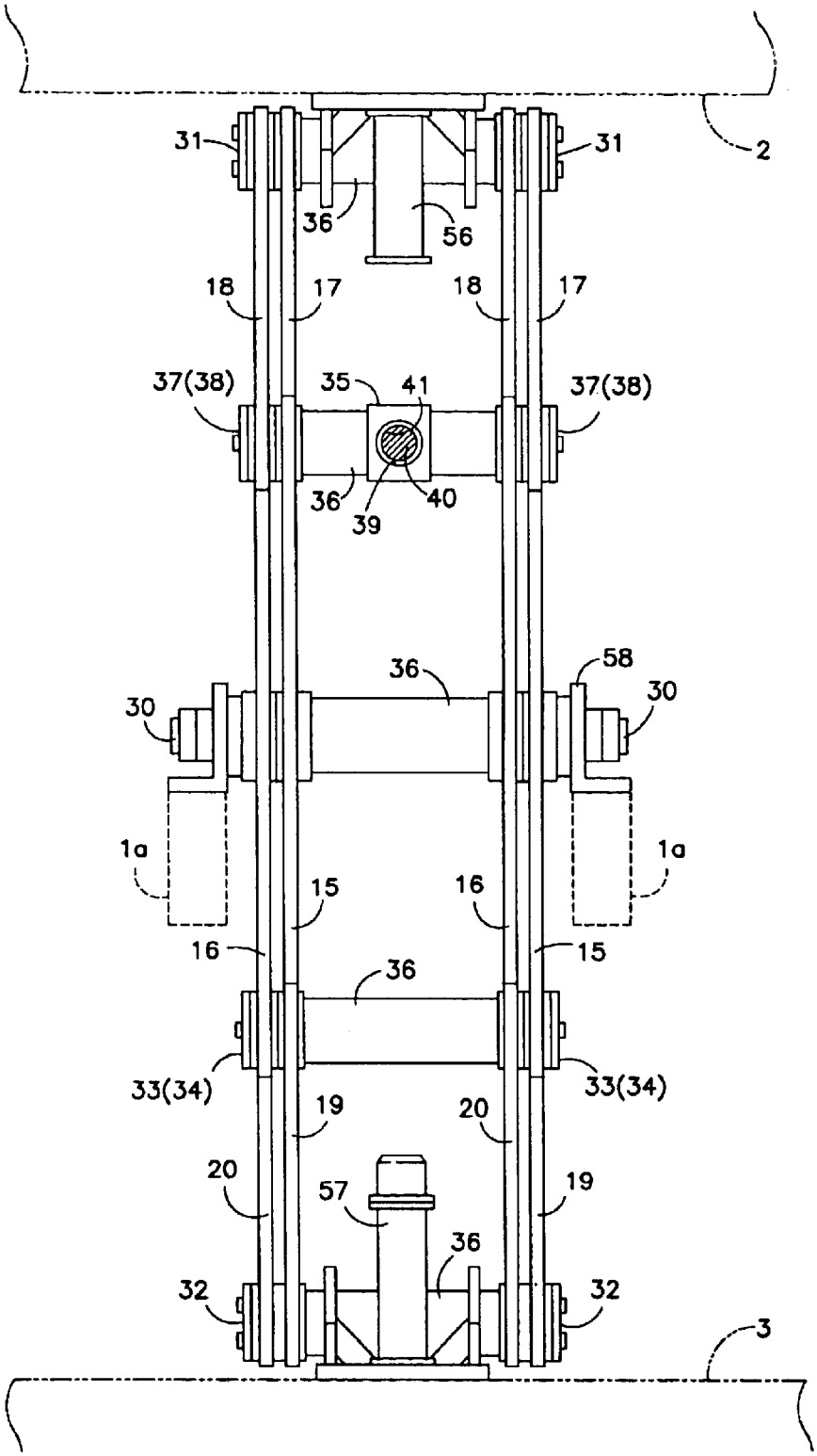
FIG. 3 is a side view of the floor height adjusting mechanism.

Cage frame (1) has supporting frame **(1*a*) nearly in its central portion. On said supporting frame (1*a*), pantograph (14) made of a link mechanism is set as the floor height adjusting mechanism. As shown in FIG. 3, pantograph (14) is composed of first and second long links (15), (16), for which the central portions have stationary shaft (30) set on supporting frame (1*a*) in a free rotatable way via bracket (58), third and fourth short links (17), (18) connected to the upper ends of said first and second links (15), (16), and fifth and sixth short links (19), (20) connected to the lower ends of said first and second links (15), (16). In consideration of the rigidity of pantograph (14), each of links (15)-(20) may be formed from two plates. The upper end portions of third and fourth links (17), (18) are connected in a free rotatable way to the lower portion of upper deck (2), and the lower end portions of fifth and sixth links (19), (20) are connected to the upper portion of lower deck (3**).

Due to its weight, upper deck (2) tends to expand the upper half portion of first and second links (15), (16), and, at the same time, they also tend to expand the lower half portion. Consequently, due to the weight of upper deck (2), a force that pulls upward acts on lower deck (3) via pantograph (14). As a result, because the weight of upper deck (2) and the weight of lower deck (3) are equal to each other, upper deck (2) and lower deck (3) balance each other exactly.

First and second links (15), (16) are assembled to an X shape with stationary shaft (30) at the center. Its upper end portion are connected to the lower ends of third and fourth links (17), (18) with movable shafts (37), (38) to form a diamond shaped upper portion. Also, the lower end portions of first and second links (15), (16) are connected to the upper end portions of fifth and sixth links (19), (20) of first and second links (15), (16) with movable shafts (33), (34), respectively, to form a diamond shaped lower portion. The upper end portions of third and fourth links (17), (18) are connected to upper deck (2) by means of an appropriate member that supports common shaft (31). The lower end portions of fifth and sixth links (19), (20) are connected in a free rotatable way to lower deck (3) with an appropriate member that supports common shaft (32). Relative stationary shafts (30), (31), (32) and movable shafts (33), (34), (37), (38) of two front/back sets of pantographs (14), (14) are connected coaxially by means of hollow shafts (36) with a prescribed length (see FIG. 3).

As shown in FIG. 3, for buffer devices (56), (57) in the central portion between pantographs (14), (14), a buffer device (56) is located on both sides of common shaft (31) of the upper deck 2 and a pair of buffer devices (57) is located on both sides of common shaft (32) of the lower deck (3). Buffer devices (56), (57), a buffer as they contact each other when pantograph (14) expands as the upper and lower decks (2), (3) approach each other.

Figure 4:
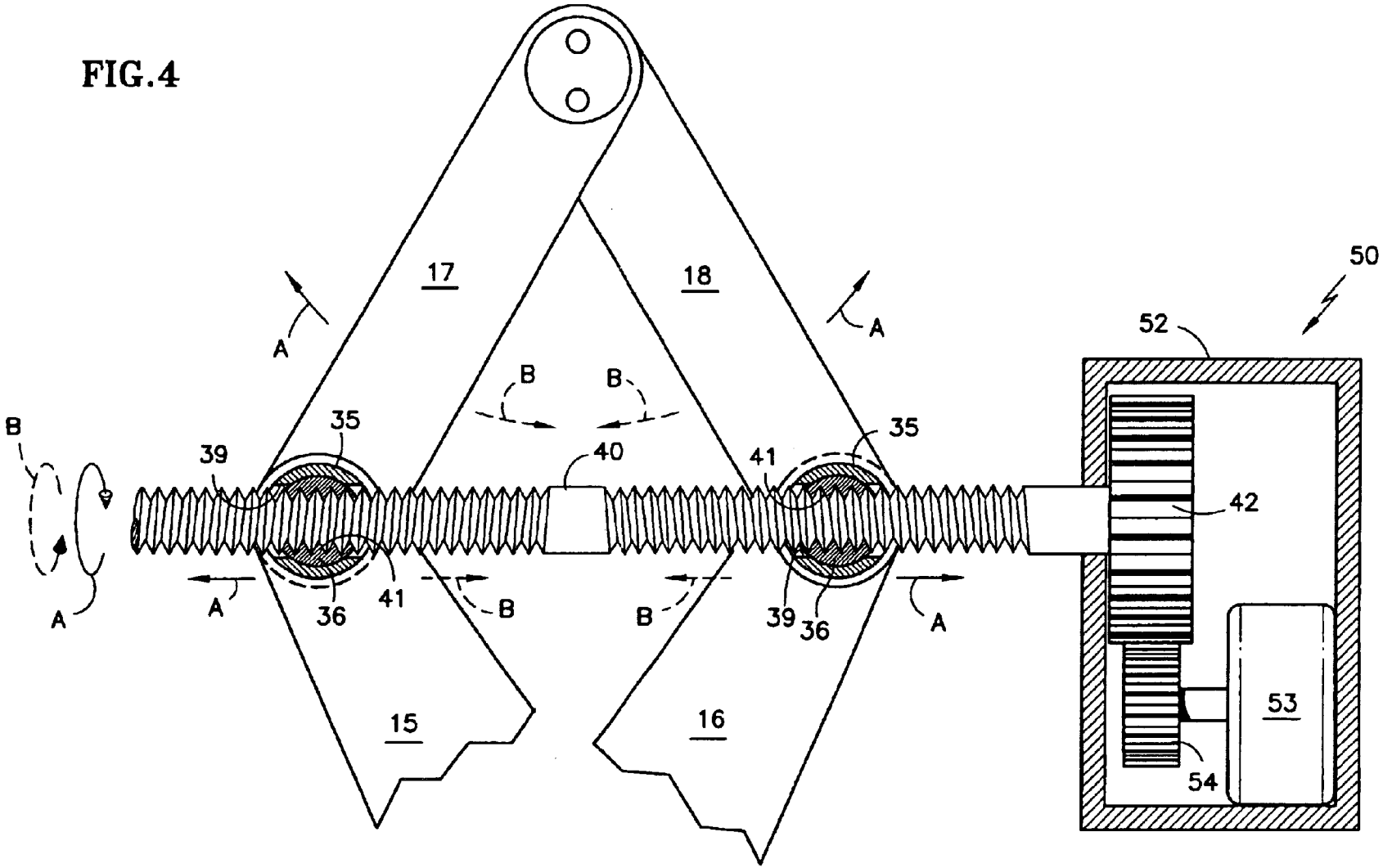
FIG. 4 is an enlarged front cross-sectional view of a portion of the floor height adjusting mechanism.

Screw shaft (40) is rotably connected to the axial centers between movable shafts (38), (37) of first and second links (15), (16) and third and fourth links (17), (18). As shown in FIG. 4, screw shaft (40) is threaded through threaded holes (41), formed orthogonal to axial length of hollow shafts (36), (36) that connect movable shafts (37), (37) and movable shafts (38), (38) of third and fourth links (17), (18) and first and second links (15), (16) in pantographs (14), (14). Collars (35) fit on hollow shafts (36) reinforce the portions of threaded holes (41). Through holes (39) are formed concentrically to threaded holes (41) and have a larger diameter.

One end portion of screw shaft (40) extends from the outerside fourth link (18) to the side of cage frame (1). As shown in FIG. 4, it is connected to driving device (50) accommodated in housing (52). As shown in FIG. 2, the other end portion of screw shaft (40) is supported in a free rotatable way around the axial center by means of a bearing (not shown in the figure) accommodated in housing (52) on the outer side of first link (15) and third link (17). Also, screw shaft (40) may be set between movable shafts (34), (33) of first and second links (15), (16) and fifth and sixth links (19), (20). In addition, a ball screw may be used in place of screw shaft (40).

As shown in FIG. 4, driving device (50) has a structure in which electric motor (53) is fixed inside housing (52), output gear (54) is attached to the output shaft of said electric motor (53) attached to the other end portion of said screw shaft (40) is a gear (42), which is drivingly engaged to said output gear (54). As shown in FIG. 2, left/right housings (52), (52) are fixed on slide blocks (51) via mounting plates (55), respectively, and slide blocks (51) are engaged in a free sliding way on sub-guide rails (12*a*), (12*b*).

In operation, the button of the destination floor is pushed by a passenger riding in upper deck (2) or lower deck (3), the signal from the destination floor button is output to a controller. From the controller, a signal is output to winding machine (5), and upper deck (2) or lower deck (3) moves toward the destination floor. The controller calculates the appropriate spacing between upper deck (2) and lower deck (3) for the destination floor and the adjacent floor. Corresponding to the calculated appropriate spacing, electric motor (53) of driving device (50) is turned ON.

Under driving of electric motor (53), as shown in FIG. 4, when screw shaft (40) is rotated forward (A), the spacing between movable shafts (37), (38) becomes larger. As a result, third and fourth links (17), (18) and first and second links (15), (16) are opened. As first and second links (15), (16) are opened, fifth and sixth links (19), (20) are opened with stationary shaft (32) at the center, so that pantograph (14) is expanded, and the upper/lower spacing between the upper and lower decks (2), (3) becomes smaller.

On the other hand, when screw shaft (40) is rotated backward (B), the spacing between movable shafts (37), (38) becomes smaller. As a result, third and fourth links (17), (18) and first and second links (15), (16) are shrunk. As first and second links (15), (16) are shrunk, fifth and sixth links (19), (20) are shrunk with stationary shaft (32) at the center, so that pantograph (14) is shrunk, and the spacing between the upper and lower decks (2), (3) becomes larger.

In summary, upper deck (2) and lower deck (3) can move toward or away from each other at the same time via pantograph (14). Consequently, spacing between said upper and lower decks (2), (3) can be adjusted quickly. Also, as housings (52), (52) that accommodate bearings on the two end portions of screw shaft (40) and driving device (40) can make vertical movement along sub-guide rails (12*a*), (12*b*) via slide shoes (51), (51), compared with the case when housings (52), (52) are fixed at prescribed positions, it is possible to have a larger opening of pantograph (14). Consequently, it is possible to make adjustment of the spacing with a larger stroke between upper deck (2) and lower deck (3).

Thus, although the invention has been shown and described with respect to exemplary embodiments thereof, it should be understood by those skilled in the art that the foregoing and various other changes, omissions and additions may be made therein without departing from the spirit and scope of the invention.

We claim:

1. A variable double deck elevator comprising:

an upper deck;

a lower deck;

a car frame aligning the upper and lower deck in a vertically superimposed relationship for movement therein;

a pantograph positioned between the upper and lower deck, wherein the pantograph includes upper portion coupled to the upper deck, a lower portion coupled to the lower deck and a center portion located between the upper and lower portions rotatably coupled to a portion of the car frame located between the upper and lower decks;

a screw shaft rotatably coupled to one of the upper and lower portions;

a driving means connected to a first end of the screw shaft for rotating the screw shaft to expand and contract the pantograph to position the upper and lower decks within the car frame.

2. The variable double deck elevator of claim 1 wherein the driving means further comprises an electric motor.

3. The variable double deck elevator of claim 1 wherein the driving means is coupled to the car frame for vertical movement therein.

4. The variable double deck elevator of claim 3 further comprising:

a housing coupled to a second end of the screw shaft to allow rotation thereof and wherein the housing is coupled to the car for vertical movement therein.

5. The variable double deck elevator of claim 1 further comprising a buffer mounted to the underside of the upper deck to limit the travel of the upper and lower decks.

6. A variable double deck elevator comprising:

an upper deck;

a lower deck;

a car frame aligning the upper and lower deck in a vertically superimposed relationship for movement therein;

a pantograph positioned between the upper and lower deck, wherein the pantograph includes a first link and a second link in which approximately the center part is rotatably coupled to a portion of the car frame located between the upper and lower deck, a third link and a fourth link respectively coupled to the top ends of said first link and second link, and a fifth link and a sixth link respectively coupled to the bottom ends of said first link and second link, with the top ends of said third link and fourth link being coupled to the upper car and with the bottom ends of said fifth link and sixth link being coupled to the lower car;

a screw shaft rotatably coupled to one of the top end and the bottom end of the first and second links;

a driving means connected to a first end of the screw shaft for rotating the screw shaft to expand and contract the pantograph to position the upper and lower decks within the car frame.

7. The variable double deck elevator of claim 6 wherein the driving means further comprises an electric motor.

8. The variable double deck elevator of claim 6 wherein the driving means is coupled to the car frame for vertical movement therein.

9. The variable double deck elevator of claim 8 further comprising:

a housing coupled to a second end of the screw shaft to allow rotation thereof and wherein the housing is coupled to the car for vertical movement therein.

10. The variable double deck elevator of claim 9 further comprising a buffer mounted to the underside of the upper deck to limit the travel of the upper and lower decks.

* * * * *